US006334474B1

(12) United States Patent
Rababy et al.

(10) Patent No.: US 6,334,474 B1
(45) Date of Patent: Jan. 1, 2002

(54) BREAKAWAY SEPARATION DETECTION AND ALERT SYSTEM

(76) Inventors: Brent D. Rababy, 2715 Abedul St., Carlsbad, CA (US) 92009; Joshua C. Goucher, 9918 Caminito Bolsa, San Diego, CA (US) 92129

( * ) Notice: Subject to any disclaimer, the term of this patent is extended or adjusted under 35 U.S.C. 154(b) by 0 days.

(21) Appl. No.: 09/842,457

(22) Filed: Apr. 26, 2001

(51) Int. Cl.[7] ..... B65B 1/30; B65B 3/28; B65B 57/06; B65B 57/14; B67C 3/00

(52) U.S. Cl. ..... 141/207; 141/94; 141/209; 222/39; 222/52; 222/75; 137/68.14; 251/129.04

(58) Field of Search ..... 141/94, 207, 209; 222/23, 39, 47, 52, 74, 75; 137/68.14; 251/129.04

(56) References Cited

U.S. PATENT DOCUMENTS

| | | | | | |
|---|---|---|---|---|---|
| 3,062,247 A | | 11/1962 | Botkin | ..... | 141/209 |
| 4,498,606 A | * | 2/1985 | DiRienzo | ..... | 222/52 |
| 5,506,570 A | | 4/1996 | Scott | ..... | 340/603 |
| 5,564,471 A | | 10/1996 | Wilder | ..... | 137/614.04 |
| 5,720,327 A | | 2/1998 | Foster, Jr. | ..... | 141/207 |
| 5,921,266 A | * | 4/1999 | Meyer | ..... | 137/68.14 |
| 6,021,823 A | | 2/2000 | Hale | ..... | 141/231 |

* cited by examiner

*Primary Examiner*—Timothy L. Maust
(74) *Attorney, Agent, or Firm*—John R. Ross; John R. Ross, III

(57) ABSTRACT

A breakaway separation detection and alerting system. A breakaway fuel hose is connected to a fuel pump. A breakaway unit connects the nozzle hose section and the fuel pump hose section of the breakaway fuel hose together. When the breakaway fuel hose is subject to tension in excess of a predetermined load, the breakaway unit will separate. An alarm activation device will then activate an alarm capable of alerting an individual remotely located from the breakaway fuel hose. In a first preferred embodiment, the at least one alarm is a first alarm and a second alarm. The first alarm is located in proximity to the fuel pump and the second alarm is located remotely where a fueling station employee can monitor it. The first preferred embodiment also has a transmitter and a receiver. When a breakaway separation condition occurs, the first alarm sounds. Also, the transmitter sends a signal to the receiver. The receiver then activates the second alarm, alerting the remotely located fueling station employee.

24 Claims, 9 Drawing Sheets

PRIOR ART

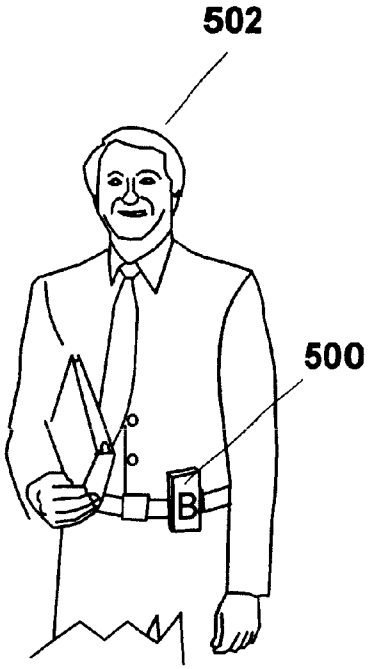
FIG. 14
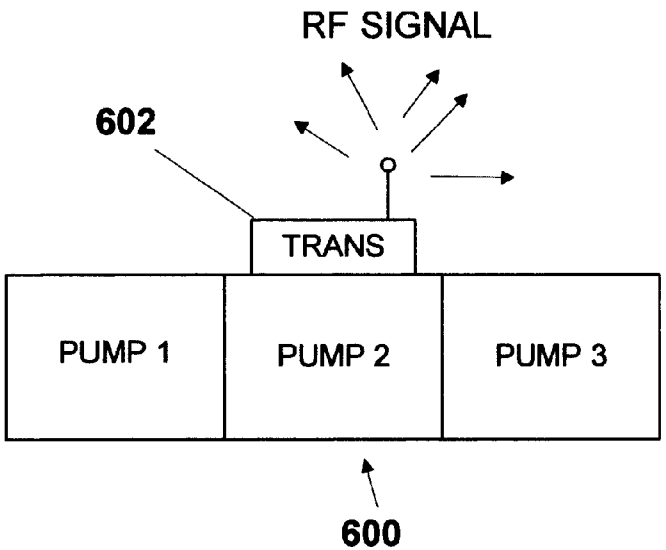

BREAKAWAY SEPARATION DETECTION AND ALERT SYSTEM

The present invention relates to fuel dispensers, and in particular to devices for preventing or minimizing damage caused by a breakaway separation.

BACKGROUND OF THE INVENTION

In recent years self-service fuel pumps at gasoline stations have become the industry standard. The majority of fuel pumps at gasoline stations are self-service as opposed to full-service. Most consumers prefer to pump their own fuel because it costs less than it does to have a gas station employee pump it. However, a consequence of allowing customers to pump their own fuel occurs when a customer forgets to remove the fuel nozzle from a vehicle's fuel tank inlet before driving away. This situation, which is commonly referred to today as either a "breakaway separation", "drive off", or a "drive away" can be very dangerous and expensive. A large gas station having four islands of three pumps per island, on average, may experience at least one breakaway separation condition per month.

To address the problem of a drive off, breakaway units have been developed. A breakaway unit enables a fuel hose to be easily and safely severed in the event of a breakaway separation condition. FIG. 13 illustrates the operation of a prior art breakaway unit during a breakaway separation condition. Breakaway unit 304 of fuel hose 307 of pump 301 has broken apart as automobile 308 has driven away with nozzle 309 in its fuel tank inlet. Upper section 305 of breakaway unit 304 remains attached to the section of fuel hose 307 connected to pump 301 and lower section 306 remains attached to the section of fuel hose 307 that is attached to nozzle 309. A valve in upper section 305 closes, thereby preventing spillage of fuel out of the section of the severed fuel hose 307 that is connected to fuel pump 301. A fuel hose breakaway unit is described in U.S. Pat. No. 5,564,471, which is herein incorporated by reference. Regardless of the utilization of breakaway units, breakaway separation conditions are still very costly. A typical repair bill can be on average anywhere from approximately $500 to $1000. The repair can even reach as high as $10,000 or more if there is dispenser damage or a fire occurs as the result of the breakaway separation. If the breakaway separation condition occurs and the gas station employee does not know about it until the driver of the automobile has left the scene, the repair cost will have to be carried by the owners of the gas station. If the driver voluntarily stops or is stopped prior to leaving the scene, his automobile liability insurance can typically be relied upon to cover the cost or repairs. In many cases when a breakaway separation occurs, the driver leaves the gas station before the employee recognizes the damage. The driver may not be aware of the damage, or if he is, he often does not report it. Therefore, usually it is the gas station owner that pays for repairs as the result of a breakaway separation.

A Prior Art Method for Addressing Drive Off Conditions

U.S. Pat. No. 3,062,247, issued to Botkin, discloses a nozzle that has a discharge tube that is attached to the nozzle valve by means of a nut that breaks "with a sound that is audible for considerable distance". However, there is no explanation in of how the Botkin device would alert a remotely located gas station employee of a breakaway separation condition. For example, it is unlikely that the sound described by Botkin would be loud enough to alert a gas station employee located in an office. Moreover, Applicants are not aware of any current application of the Botkin device.

What is needed is a device for providing ample warning to remotely located gas station employees that a breakaway separation has occurred.

SUMMARY OF THE INVENTION

The present invention provides a breakaway separation detection and alerting system. A breakaway fuel hose is connected to a fuel pump. A breakaway unit connects the nozzle hose section and the fuel pump hose section of the breakaway fuel hose together. When the breakaway fuel hose is subject to tension in excess of a predetermined load, the breakaway unit will separate. An alarm activation device will then activate an alarm capable of alerting an individual remotely located from the breakaway fuel hose. In a first preferred embodiment, the at least one alarm is a first alarm and a second alarm. The first alarm is located in proximity to the fuel pump and the second alarm is located remotely where a fueling station employee can monitor it. The first preferred embodiment also has a transmitter and a receiver. When a breakaway separation condition occurs, the first alarm sounds. Also, the transmitter sends a signal to the receiver. The receiver then activates the second alarm, alerting the remotely located fueling station employee.

BRIEF DESCRIPTION OF THE DRAWINGS

FIG. 14 shows another preferred embodiment of the present invention.

DETAILED DESCRIPTION OF THE PREFERRED EMBODIMENTS

A detailed description of the preferred embodiments of the present invention can be seen by reference to FIGS. 1–12 and 14.

First Preferred Embodiment

Figure 1:
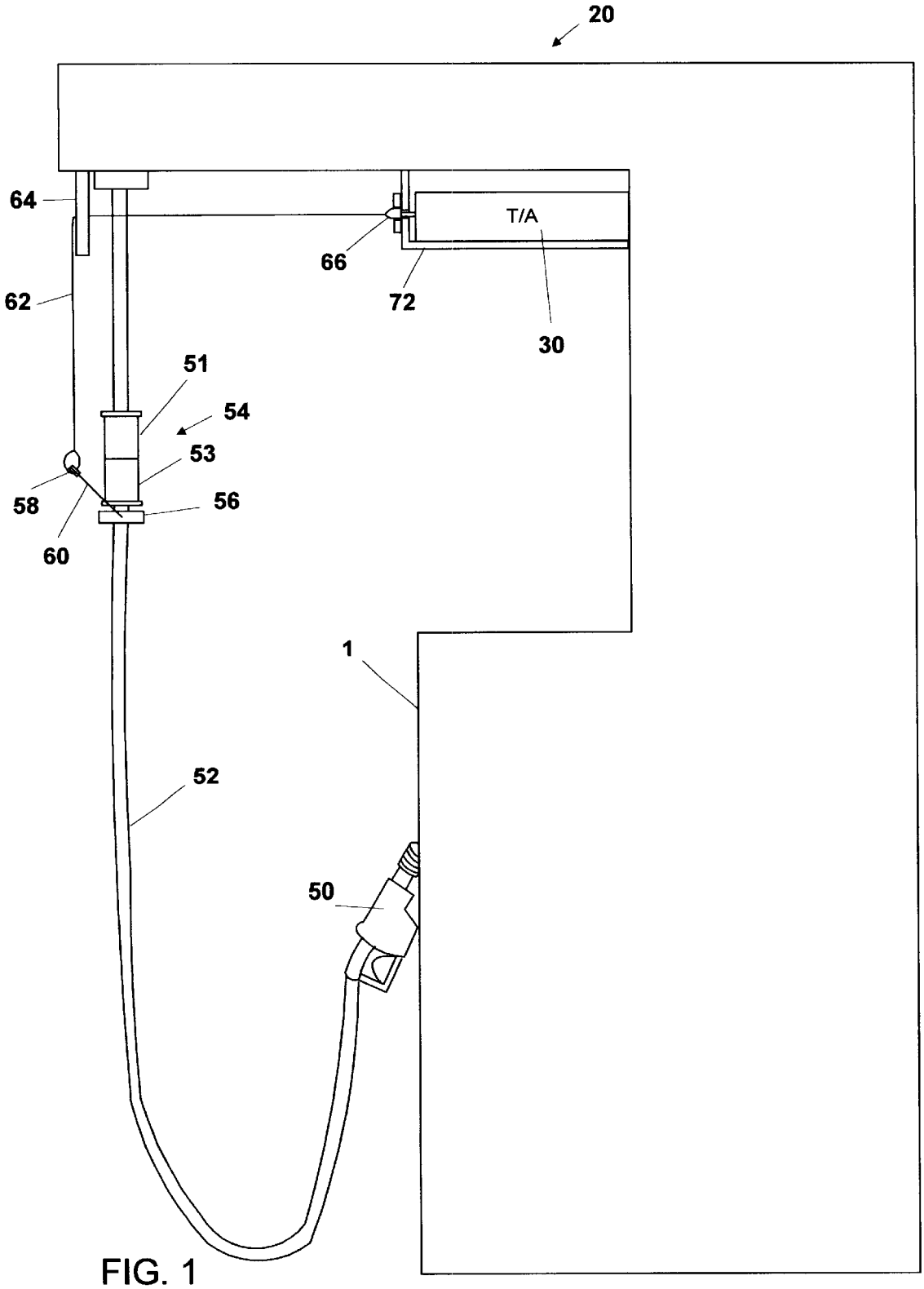
FIG. 1 shows a side view of a preferred embodiment of the present invention.
Figure 2:
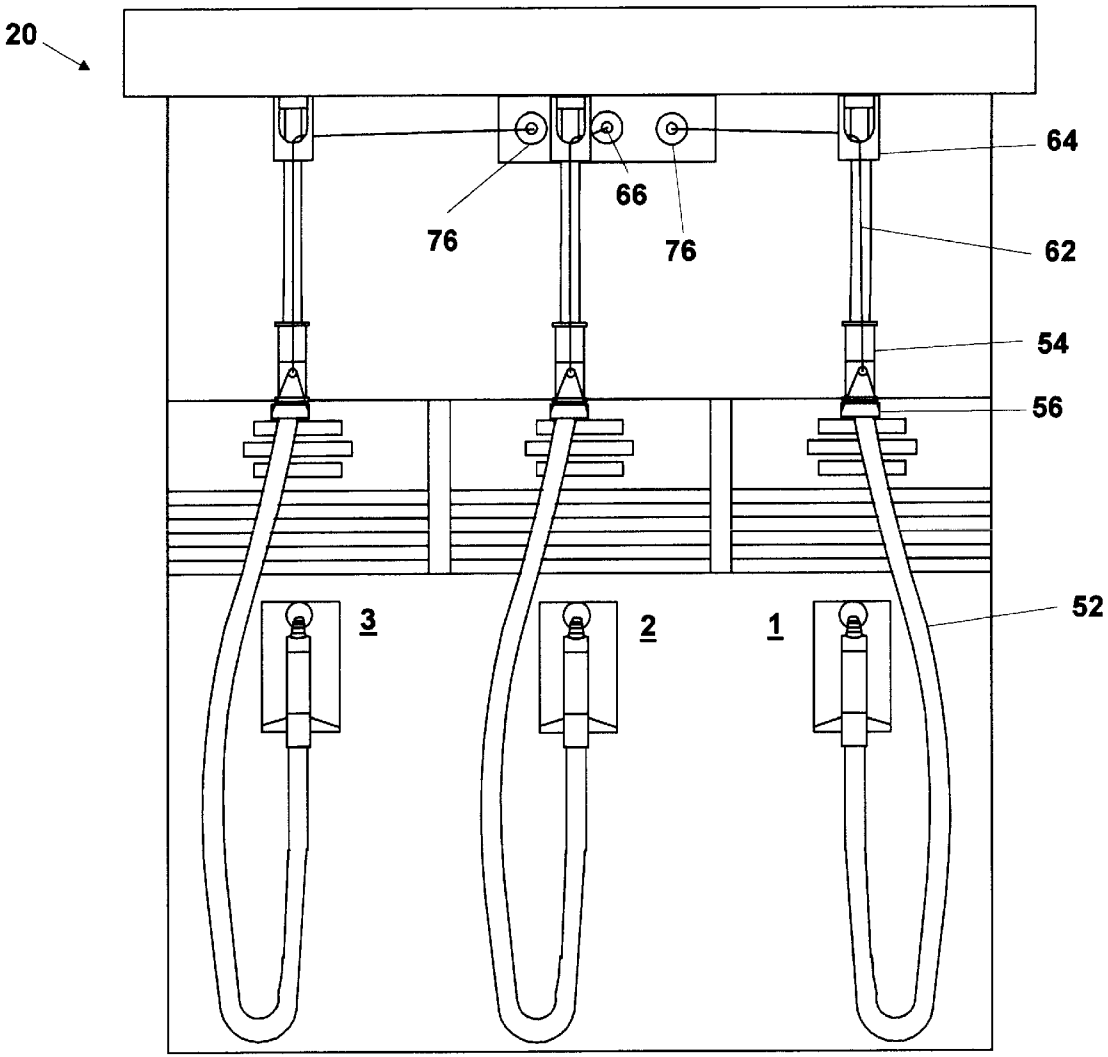
FIG. 2 shows a front view of a preferred embodiment of the present invention.

FIG. 1 shows a side view of nozzle 50 inserted into fuel pump 1 of island 20. FIG. 2 shows a front view of island 20.

In addition to fuel pump 1, island 20 also has fuel pumps 2 and 3. As shown in FIG. 1, fuel hose 52 is connected at one end to nozzle 50 and at its other end to breakaway unit 54. Breakaway unit 54 has an upper section 51 and a lower section 53 that are connected to each other. In a preferred embodiment, when fuel hose 52 is subject to a tension force of 250 lbs., lower section 53 will separate from upper section 51.

Figure 7:
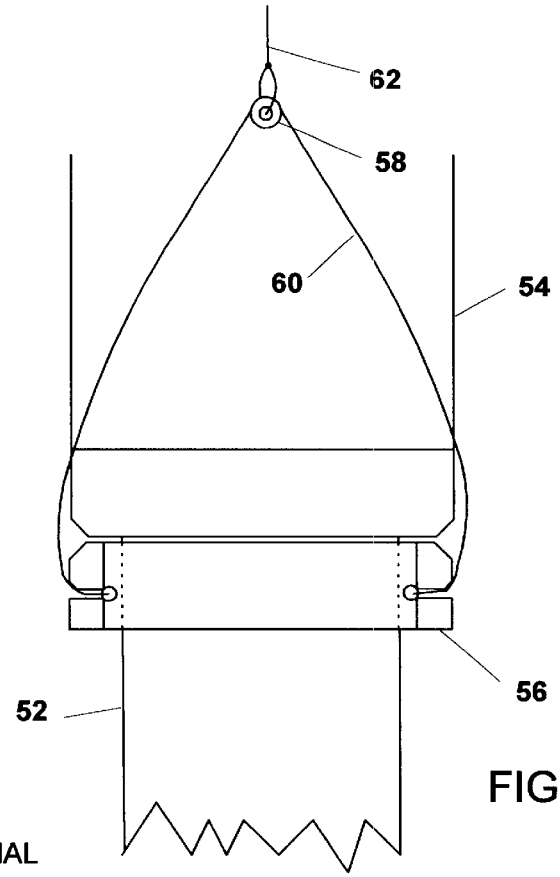
FIG. 7 shows a detailed view of an embodiment of the present invention.

FIG. 7 shows a detailed view of fuel hose 52 connected to breakaway unit 54. Collar 56 is loosely slid over fuel hose 52. Collar 56 hangs from swivel joint 58 via cable 60 so that it is situated below breakaway unit 54.

Figure 4:
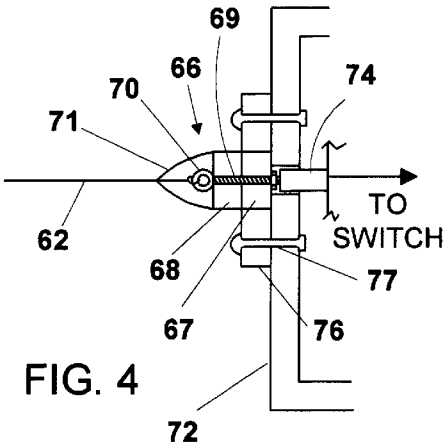
FIG. 4 shows a detailed view of an embodiment of the present invention.

As shown in FIGS. 1 and 2, rigid support 64 extends downward from island 20. Cable 62 is connected to swivel joint 58 at one end, is then run through rigid support 64, and is connected to magnetic unit 66 at its other end. A detailed view of magnetic unit 66 is shown in FIG. 4. In a preferred embodiment, rare earth magnets 67 and 68 are bolted together via bolt 69. Bolt 69 has loop 70 attached at its end. Split rubber pointed end piece 71 is held secure against magnet 68 via loop 70. Preferably, split rubber pointed end piece 71 is also glued to magnet 68. Cable 62 is looped through loop 70 of bolt 69.

Magnetic attractive force holds magnetic unit 66 flush against metallic support box 72. When magnetic unit 66 is in place and flush against metallic support box 72, it presses against button 74. Button 74 is connected to transmitter/alarm 30, as shown in FIG. 1. Guide plate 76 functions to help properly position magnetic unit 66 flush against metallic support box 72 and centered over button 74, as shown in FIG. 2 and FIG. 4. Preferably, guide plate 76 is riveted to metallic support box 72 via rivets 77.

Operation of the First Preferred Embodiment

Figure 3:
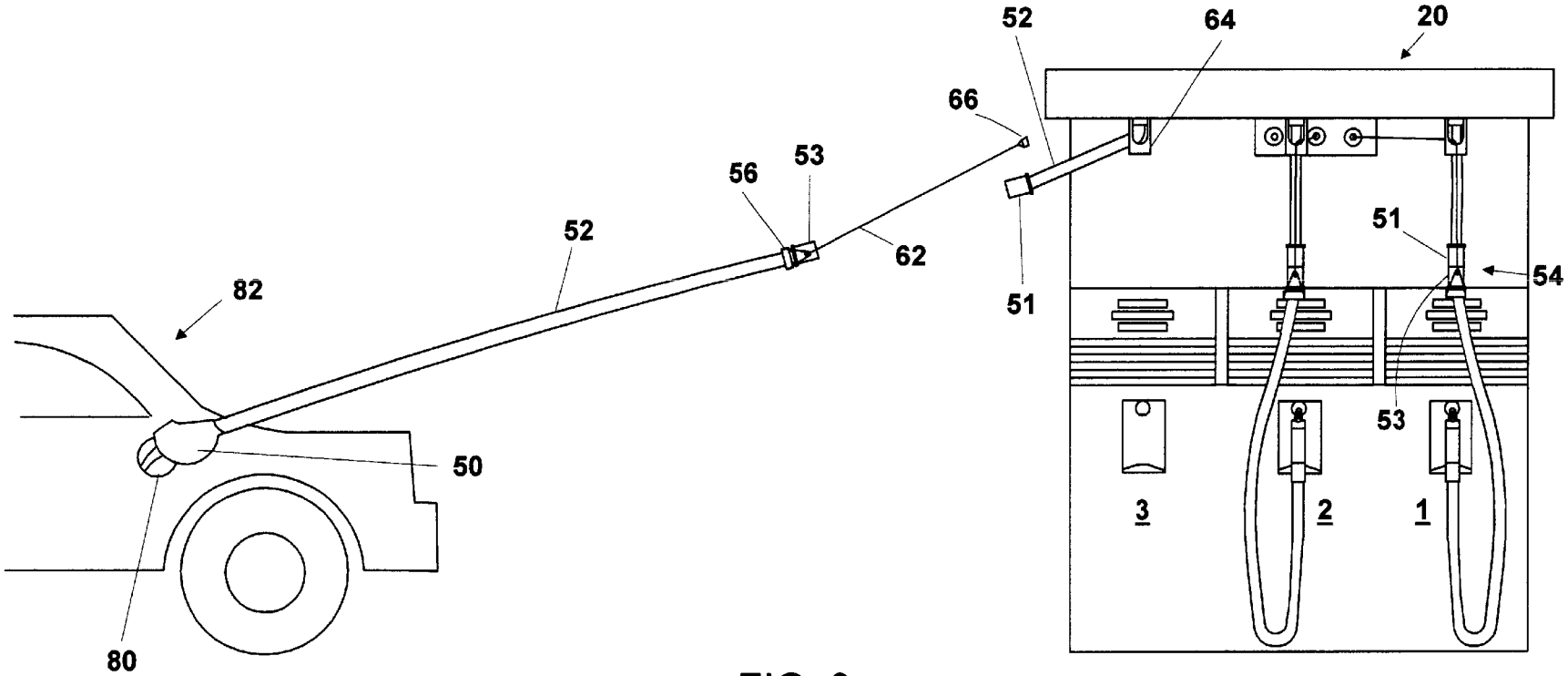
FIG. 3 shows the present invention during a breakaway separation condition.

FIG. 3 shows nozzle 50 of pump 3 inserted through gas tank inlet 80 of automobile 82. In FIG. 3, automobile 82 has driven away from island 20 without removing nozzle 50. This has caused fuel hose 52 to break at breakaway unit 54. Lower section 53 is attached to the section of fuel hose 52 that is attached to nozzle 50 and upper section 51 is attached to the section of fuel hose 52 that is attached to fuel pump 3.

As lower section 53 separates from upper section 51, it pulls collar 56 along with it. Collar 56 pulls cable 62, which in turn pulls magnetic unit 66. As automobile 82 is driven away, magnetic unit 66 is pulled away from island 20 through support 64.

Figure 5:
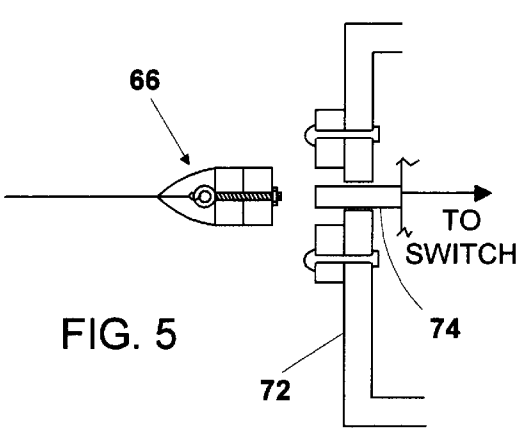
FIG. 5 shows a detailed view of an embodiment of the present invention.
Figure 9:
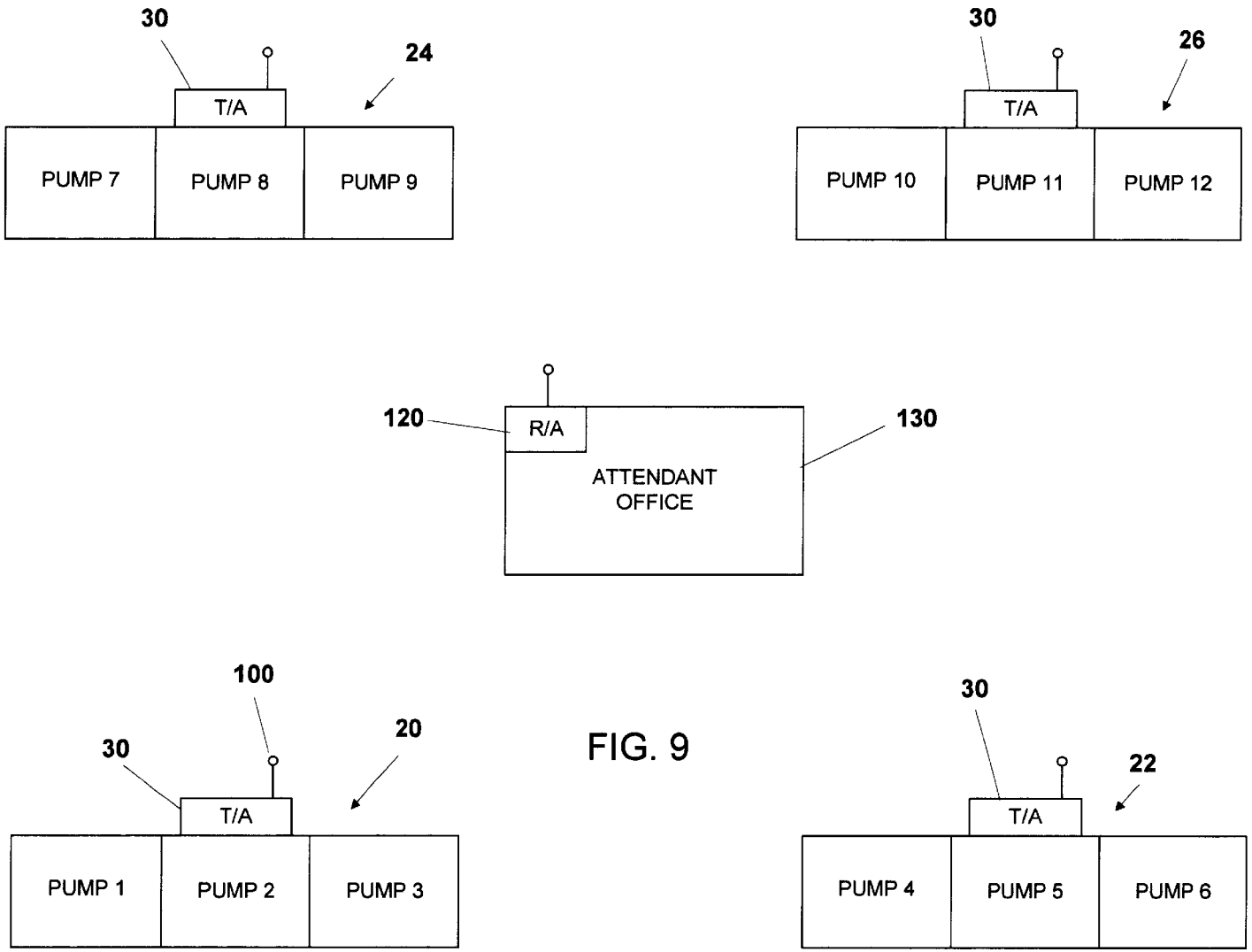
FIG. 9 shows a preferred embodiment of the present invention.

FIG. 5 shows a detailed view of magnetic unit 66 being pulled away from metallic support box 72. As magnetic unit 66 is pulled away, pressure is released from button 74, allowing it to expand. As button 75 expands, a loud, audible alarm sounds and flashing lights go off at transmitter/alarm 30. Also, a RF signal is transmitted from transmitter/alarm 30 so that it can be received by receiver/alarm 120 in employee office 130, as shown in FIG. 9. As with transmitter/alarm 30, receiver/alarm 120 also emits a loud, audible alarm and flashing lights as a warning that a breakaway separation has occurred. Details of the operation of transmitter/alarm 30 and receiver/alarm 120 are given below.

Transmitter

Figure 6:
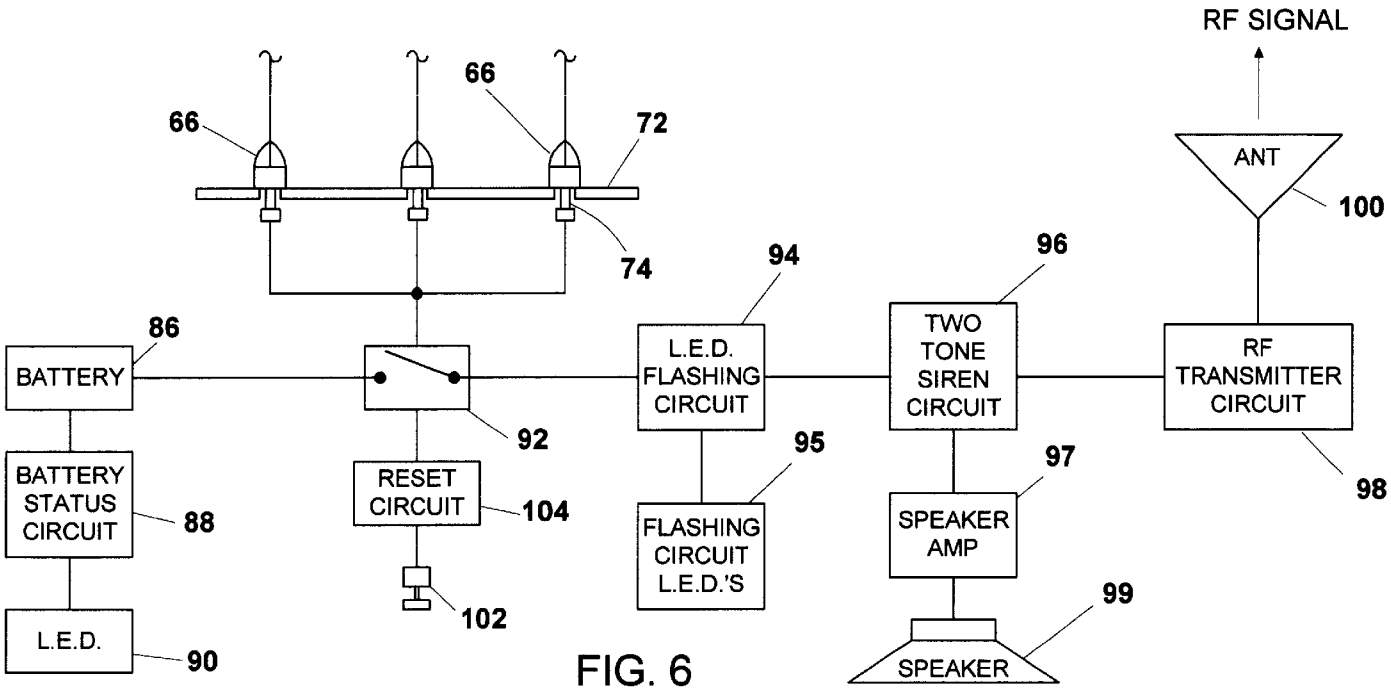
FIG. 6 is a simplified drawing of a preferred transmitter/alarm.

FIG. 6 shows a simplified drawing of the components of a preferred transmitter/alarm 30. In the first preferred embodiment, transmitter/alarm 30 is powered by battery 86. One advantage of making transmitter/alarm 30 battery powered is that it becomes relatively easy to install. Battery status circuit 88 is connected to battery 86 and directs current to L.E.D. 90. By monitoring L.E.D. 90, an employee is able to verify that battery 86 has sufficient charge to power transmitter/alarm 30.

Switch 92 is connected to battery 86. As explained above, when magnetic unit 66 is pulled away, pressure is released from button 74, allowing it to expand. When button 74 expands a circuit (not shown) is closed sending an electrical signal to switch 92 causing it to close. Current is then allowed to flow from battery 86 to L.E.D. flashing circuit 94, two tone siren circuit 96 and RF transmitter circuit 98. L.E.D. flashing circuit 94 directs current flow to flashing circuit L.E.D.'s 95. Two tone siren circuit directs current flow to speaker amp 97 which amplifies speaker 99. RF transmitter circuit 98 converts the signal from battery 86 to a radio frequency signal that is transmitted from transmitter/alarm 30 via antenna 100. In a preferred embodiment, the RF signal leaving antenna 100 is a FM signal.

Reset circuit 104 is connected to switch 92. By pressing button 102, the employee can cause switch 92 to open, which breaks the flow of current to L.E.D. flashing circuit 94, two tone siren circuit 96 and RF transmitter circuit 98. Also, in the preferred embodiment, when magnetic unit 66 is replaced, button 74 is collapsed. This causes switch 92 to open.

Receiver

Figure 8:
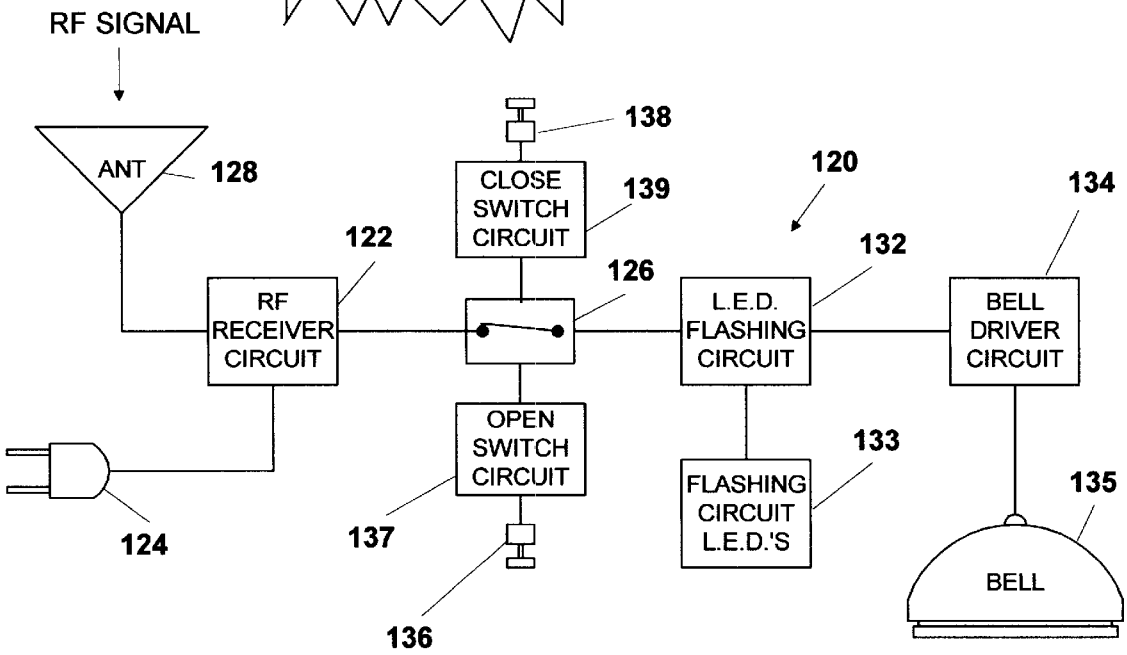
FIG. 8 shows a simplified drawing of a preferred receiver/alarm.

FIG. 8 shows a simplified drawing of the components of a preferred receiver/alarm 120. Preferably, receiver/alarm 120 is located in the employee office 130, as shown in FIG. 9. As shown in FIG. 8, power plug 124 connects receiver/alarm 120 to a suitable power source, such as a rectified and regulated standard household electric circuit. The RF signal transmitted from antenna 100 (FIG. 6) is received by antenna 128 and is directed to RF receiver circuit 122 where it is converted to an electrical signal. Switch 126 is normally in the closed position and allows current from RF receiver circuit 122 to be directed to L.E.D. flashing circuit 132 and bell driver circuit 134. RF receiver circuit 132 directs current flow to flashing circuit L.E.D.'s 133 and bell driver circuit 134 directs current flow to bell 135. The ringing of bell 135 and the flashing of flashing circuit L.E.D.'s 133 alerts the employee stationed in employee office 130 that a breakaway separation has occurred.

The employee can turn off bell 135 and flashing circuit L.E.D.'s 133 by pressing button 136. Pressing button 136 causes open switch circuit 137 to open switch 126. Likewise, the employee can close switch 126 by pressing button 138. Pressing button 138 causes close switch circuit 139 to close switch 126.

Use of the First Preferred Embodiment with Multiple Islands at a Gas Station FIG. 9 shows island 20 (having pump 1, pump 2 and pump 3), island 22 (having pump 4, pump 5 and pump 6), island 24 (having pump 7, pump 8 and pump 9) and island 26 (having pump 10, pump 11 and pump 12). Each island has its own transmitter/alarm 30. In the first preferred embodiment, each transmitter/alarm 30 transmits a RF signal at the same frequency. Therefore, for example, if a breakaway separation condition occurred at pump 8, an audible and visual alarm would be emitted at transmitter/alarm 30 at island 24. Also, a RF signal would be transmitted by transmitter/alarm 30 and received at receiver/alarm 120 in employee office 130 where an audible and visual alarm would be emitted. The employee would know that somewhere at the gas station a breakaway separation condition has occurred. After leaving the employee office, he would be able to observe each of the islands and immediately determine where the condition occurred. At this point, for example, the driver of the vehicle will hear the sound of transmitter/alarm 30 and will most likely voluntarily stop his vehicle. If the driver of the vehicle does not stop and proceeds to drive away from the gas station, the employee (alerted by transmitter/alarm 30 and/or receiver/alarm 120) can record his license plate and report the incident to the police. The driver of the vehicle can then be held accountable for all necessary repairs as the result of the breakaway separation.

Cost Savings Benefit of the Present Invention

Applicant estimates that the cost of purchasing and installing transmitter/alarm 30 at an island having three pumps is approximately $300.00. Applicant also estimates that the cost of purchasing and installing receiver/alarm 120 in the employee's office is approximate $250.00. Therefore, if a gas station has four islands and one employee's office, the total cost to purchase and install the present invention on each island at the gas station and in the employee's office is approximately $1450.00. If it is assumed that the gas station owner pays on average $500 per month to repair breakaway separation resultant damage, in the first year a gas station owner will save approximately $4550 (12 months×$500/month−$1450=$4550). Thereafter, the gas station owner may save approximately $6000 per year by utilization of the present invention.

Second Preferred Embodiment

Figure 10:
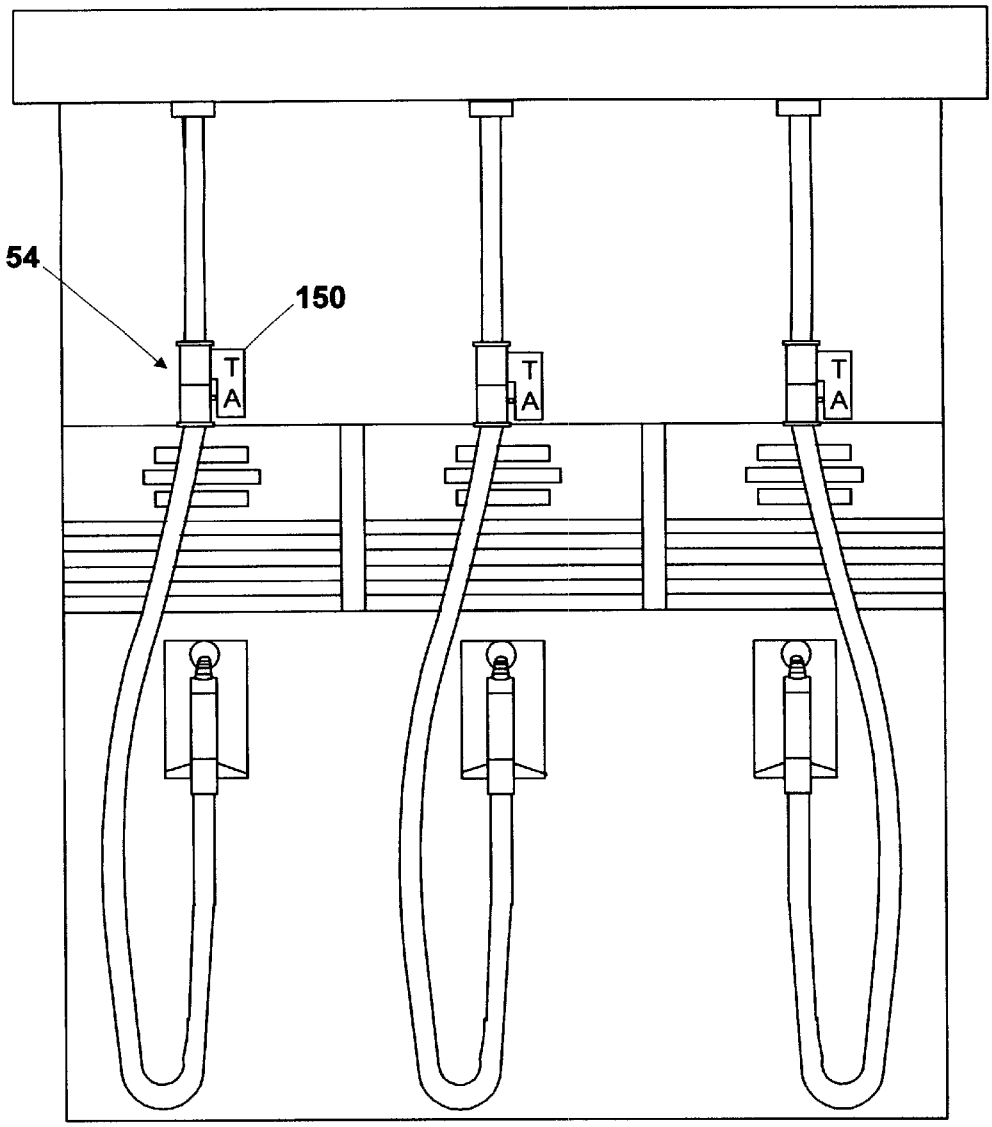
FIGS. 10–12 show another preferred embodiment of the present invention.
Figure 11:
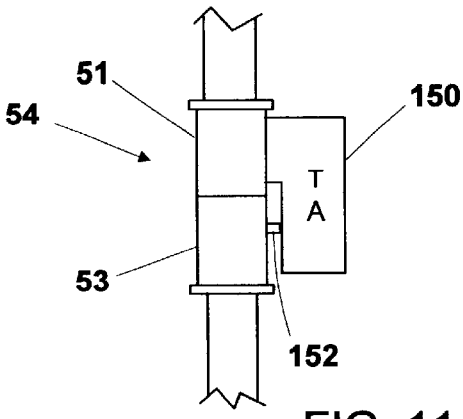
Figure 12:
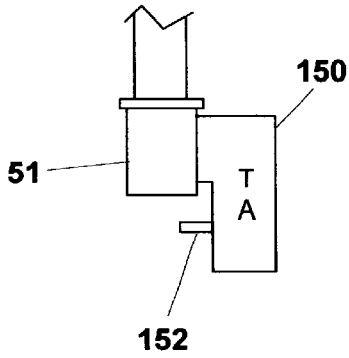
Figure 13:
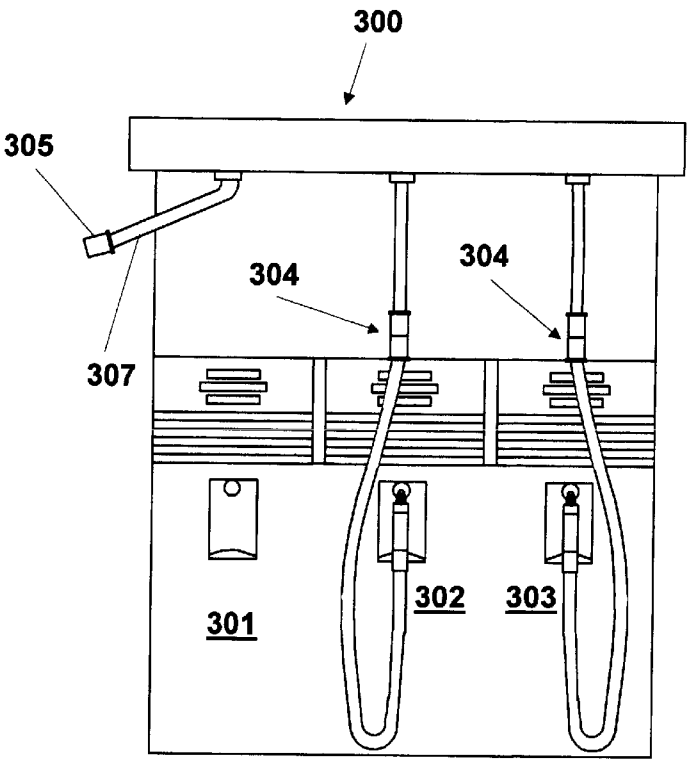
FIG. 13 illustrates the operation of a prior art breakaway unit.
Figure 13:
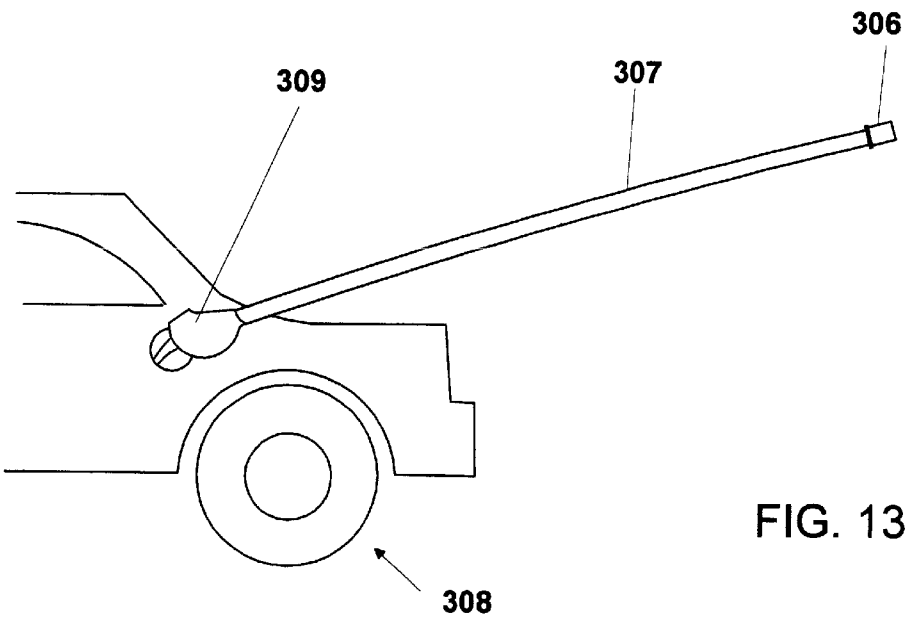

A second preferred embodiment is shown in FIGS. 10–12. The second preferred embodiment shows that it is possible to attach transmitter/alarm 150 directly to breakaway unit 54, as shown in FIGS. 10 and 11. FIG. 11 shows transmitter/alarm 150 rigidly attached to upper section 51. Pressure from lower section 53 holds button 152 in a compressed state. When a breakaway separation condition occurs, lower section 53 is removed, as shown in FIG. 12. The pressure on button 152 is released and button 152 is allowed to expand. As button 152 expands, a loud, audible alarm sounds and flashing lights go off at transmitter/alarm 150. Also, a RF signal is transmitted from transmitter/alarm 150 so that it can be received by receiver/alarm 120 in employee office 130. As with transmitter/alarm 150, receiver/alarm 120 also emits a loud, audible alarm and flashing lights as a warning that a breakaway separation has occurred. Details of the operation of transmitter/alarm 150 are similar to those of transmitter/alarm 30 that are described above.

Third Preferred Embodiment

In both the first and second preferred embodiments, the present invention was described such that when a breakaway separation has occurred, a visual and audible alarm is emitted at the actual island where the breakaway separation occurred and a RF signal is sent to an employee office where there is a receiver and another visual and audible alarm. In the third preferred embodiment, there is only an electrical alarm at the gas pump and no transmitter. The internal components of the alarm for the third preferred embodiment are similar to those shown in FIG. 6 for transmitter/alarm 30, except that RF transmitter circuit 98 and antenna 100 are omitted. In the third preferred embodiment, the alarm is preferably loud enough so that an employee can hear it at remote locations of the gas station. A preferred audible alarm would emit a siren sound that would measure approximately 100 dbA at 50 feet in any direction from the alarm. A typical fire engine siren emits a sound that is approximately 100 dbA at 50 feet in front of the fire engine.

Fourth Preferred Embodiment

In the fourth preferred embodiment, RF transmitter 602 is connected to island 600 with pumps 1–3, as shown in FIG. 14. RF transmitter 602 is configured to emit an RF signal when a breakaway separation condition occurs at island 600 in a fashion similar to that described above for transmitter/alarm 30 in the first preferred embodiment. However, RF transmitter 602 preferably does not have a visual or audio alarm. In the fourth preferred embodiment employee 502 wears beeper 500 that emits a beeping noise that the employee can hear when it receives a RF signal generated by RF transmitter 602. Beeper 500 is a portable receiver/alarm. After hearing beeper 500, employee 502 will know immediately that a breakaway separation condition has occurred.

Although the above-preferred embodiments have been described with specificity, persons skilled in this art will recognize that many changes to the specific embodiments disclosed above could be made without departing from the spirit of the invention. For example, although the above preferred embodiments specifically discussed the utilization of the present invention at gas stations, it could be used with equal effectiveness at all types of fueling stations. Also, although in referring to FIG. 9 while discussing the first preferred embodiment it was stated that each transmitter/alarm 30 transmits a RF signal at the same frequency, it would also be possible to configure each transmitter/alarm 30 to transmit at its own unique frequency. Then, receiver/alarm 120 could likewise be configured to sound a unique visual and/or audible alarm depending on which island the breakaway separation occurred. Therefore, the employee would be able to know immediately which island the breakaway separation occurred at without having to leave employee office 130. Also, although the first preferred embodiment showed transmitter/alarm 30 as a separate item that be easily mounted to an island, it is also possible to build an island or a gas pump with transmitter/alarm 30 already installed. Moreover, receiver/alarm 120 could easily be integrated into the dispenser control system typically monitored by the gas station employee operating the cash register. Also, although the first and second preferred embodiments stated the transmitter/alarm 30 transmits an RF signal, it would be possible to configure it to transmit other types of signals that could be received by receiver/alarm 120. For example, transmitter/alarm 30 could transmit an optical signal or an infrared signal. Also, transmitter/alarm 30 could be electrically connected to receiver/alarm 120 via an electrically conductive wire. Also, although it is stated that in the above preferred embodiments that receiver/alarm 120 is located in the employee's office, receiver/alarm 120 can be located at other locations, such as in the repair garage or in the wash room. Also, several receiver/alarms 120 could be placed throughout the gas station so that the employee could be sure to hear it wherever he may be. Therefore, the attached claims and their legal equivalents should determine the scope of the invention.

We claim:

1. A breakaway separation detection and alerting system, comprising:

A. a breakaway fuel hose connected to a fuel pump, said breakaway fuel hose comprising:

i. a nozzle hose section comprising a nozzle, and ii. a fuel pump hose section,

B. a breakaway unit connecting said nozzle hose section and said fuel pump hose section and configured to break separating said sections when tension in excess of a predetermined tension is applied to said breakaway fuel hose, C. at least one alarm device capable of alerting an individual remotely located from said breakaway fuel hose, and D. an alarm activation device configured to activate said at least one alarm device when said breakaway unit separates.

2. The breakaway separation detection and alerting system as in claim 1, wherein said alarm activation device comprises:

A. a first activation end in contact with said nozzle hose section, and

B. a second activation end in contact with said at least one alarm device, wherein when said breakable connection breaks, said first activation end and said second activation end are pulled away with said nozzle hose section so that said second activation end's contact with said at least one alarm device is broken, thereby activating said at least one alarm device.

3. The breakaway separation detection and alerting system as in claim 1, wherein said at least one alarm device comprises an alarm button, and wherein said alarm activation device comprises:

A. a collar slid over said nozzle hose section and between said nozzle and said breakaway unit, B. a magnetic unit held in contact with said button by magnetic force, and C. a cable connecting said collar to said magnetic unit, wherein when said breakaway unit separates, said collar pulls said cable and said cable pulls said magnetic unit so that said magnetic force is overcome and said alarm button contact is broken activating said at least one alarm device.

4. The breakaway separation detection and alerting system as in claim 1, further comprising:

A. a transmitter for transmitting a signal when activated by said alarm activation device, and B. a receiver, configured to receive said signal and in response activate said at least one alarm device.

5. The breakaway separation detection and alerting system as in claim 4, wherein said at least one alarm device comprises a portable receiver/alarm worn by a fueling station employee.

6. The breakaway separation detection and alerting system as in claim 1, wherein said at least one alarm device comprises an audible warning system.

7. The breakaway separation detection and alerting system as in claim 1, wherein said at least one alarm device comprises a visual warning system.

8. The breakaway separation detection and alerting system as in claim 1, wherein said at least one alarm device is a first alarm and a second alarm, wherein said first alarm is located in the proximity of said breakaway fuel hose, and wherein said second alarm is remotely located.

9. The breakaway separation detection and alerting system as in claim 1, wherein said at least one alarm device is a first alarm and a second alarm, wherein said first alarm comprises an alarm button and is located in the proximity of said breakaway fuel hose, and wherein said second alarm is remotely located, wherein said breakaway alarm system further comprises:

A. a transmitter, and

B. a receiver, wherein said transmitter is activated by said alarm activation device to transmit a signal to be received by said receiver, wherein said receiver activates said second alarm, wherein said first alarm comprises an alarm button, wherein said alarm activation device comprises:

i. a collar slid over said nozzle hose section and between said nozzle and said breakaway unit, ii. a magnetic unit held in contact with said alarm button by magnetic force, and iii. a cable connecting said collar to said magnetic unit, wherein when said breakaway unit separates, said collar pulls said cable and said cable pulls said magnetic unit so that said magnetic force is overcome and said alarm button contact is broken activating said first alarm and activating said transmitter to transmit a signal to be received by said receiver to activate said second alarm.

10. The breakaway separation detection and alerting system as in claim 1, wherein said breakaway fuel hose connected to a fuel pump is a plurality of breakaway fuel hoses connected to a plurality of fuel pumps, wherein said plurality of breakaway fuel hoses connected to said plurality of fuel pumps are grouped in a plurality of fuel pump islands, further comprising:

A. a transmitter located at each of said plurality of fuel pump islands, and

B. a receiver remotely located from said plurality of fuel pump islands wherein each said transmitter is activated by said alarm activation device to transmit a signal to be received by said receiver, wherein said receiver activates at least one alarm device.

11. The breakaway separation detection and alerting system as in claim 10, wherein said fuel pump island transmitters transmits RF signals at identical frequencies.

12. The breakaway separation detection and alerting system as in claim 10, wherein said fuel pump island transmitters transmits RF signals at unique frequencies.

13. A breakaway separation detection and alerting system, comprising:

A. A breakaway fuel hose means connected to a fuel pump, said breakaway fuel hose means comprising:

i. a nozzle hose section comprising a nozzle, and ii. a fuel pump hose section,

B. a breakaway fuel hose means connecting said nozzle hose section and said fuel pump hose section and configured to break separating said sections when tension in excess of a predetermined tension is applied to said breakaway fuel hose means, C. at least one alarm means capable of alerting an individual remotely located from said breakaway fuel hose means, and D. an alarm activation means configured to activate said at least one alarm means when said breakaway unit means separates.

14. The breakaway separation detection and alerting system as in claim 13, wherein said alarm activation means comprises:

A. a first activation end in contact with said nozzle hose section, and

B. a second activation end in contact with said at least one alarm means, wherein when said breakable connection breaks, said first activation end and said second activation end are pulled away with said nozzle hose section so that said second activation end's contact with said at least one alarm means is broken, thereby activating said at least one alarm means.

15. The breakaway separation detection and alerting system as in claim 13, wherein said at least one alarm means comprises an alarm button, and wherein said alarm activation means comprises:

A. a collar slid over said nozzle hose section and between said nozzle and said breakaway unit means, B. a magnetic unit held in contact with said button by magnetic force, and C. a cable connecting said collar to said magnetic unit, wherein when said breakaway unit means separates, said collar pulls said cable and said cable pulls said magnetic unit so that said magnetic force is overcome and said alarm button contact is broken activating said at least one alarm means.

16. The breakaway separation detection and alerting system as in claim 13, further comprising:

A. a transmitter means for transmitting a signal when activated by said alarm activation means, and B. a receiver means, configured to receive said signal and in response activate said at least one alarm means.

17. The breakaway separation detection and alerting system as in claim 16, wherein said at least one alarm means comprises a portable receiver/alarm means worn by a fueling station employee.

18. The breakaway separation detection and alerting system as in claim 13, wherein said at least one alarm means comprises an audible warning system.

19. The breakaway separation detection and alerting system as in claim 13, wherein said at least one alarm means comprises a visual warning system.

20. The breakaway separation detection and alerting system as in claim 13, wherein said at least one alarm means is a first alarm and a second alarm, wherein said first alarm is located in the proximity of said breakaway fuel hose means, and wherein said second alarm is remotely located.

21. The breakaway separation detection and alerting system as in claim 13, wherein said at least one alarm means is a first alarm and a second alarm, wherein said first alarm comprises an alarm button and is located in the proximity of said breakaway fuel hose means, and wherein said second alarm is remotely located, wherein said breakaway alarm system further comprises:

A. a transmitter means, and

B. a receiver means, wherein said transmitter means is activated by said alarm activation means to transmit a signal to be received by said receiver means, wherein said receiver means activates said second alarm, wherein said first alarm comprises an alarm button, wherein said alarm activation means comprises:

i. a collar slid over said nozzle hose section and between said nozzle and said breakaway unit means, ii. a magnetic unit held in contact with said alarm button by magnetic force, and iii. a cable connecting said collar to said magnetic unit, wherein when said breakaway unit means separates, said collar pulls said cable and said cable pulls said magnetic unit so that said magnetic force is overcome and said alarm button contact is broken activating said first alarm and activating said transmitter means to transmit a signal to be received by said receiver means to activate said second alarm.

22. The breakaway separation detection and alerting system as in claim 13, wherein said breakaway fuel hose means connected to a fuel pump is a plurality of breakaway fuel hose means connected to a plurality of fuel pumps, wherein said plurality of breakaway fuel hose means connected to said plurality of fuel pumps are grouped in a plurality of fuel pump islands, further comprising:

A. a transmitter means located at each of said plurality of fuel pump islands, and B. a receiver means remotely located from said plurality of fuel pump islands wherein each said transmitter means is activated by said alarm activation means to transmit a signal to be received by said receiver means, wherein said receiver means activates at least one alarm means.

23. The breakaway separation detection and alerting system as in claim 22, wherein said fuel pump island transmitter means transmits RF signals at identical frequencies.

24. The breakaway separation detection and alerting system as in claim 22, wherein said fuel pump island transmitter means transmits RF signals at unique frequencies.

* * * * *